US011205364B2

(12) United States Patent
Liu et al.

(10) Patent No.: US 11,205,364 B2
(45) Date of Patent: Dec. 21, 2021

(54) GATE DRIVING CIRCUIT AND DISPLAY SUBSTRATE

(71) Applicant: BOE TECHNOLOGY GROUP CO., LTD., Beijing (CN)

(72) Inventors: Libin Liu, Beijing (CN); Can Zheng, Beijing (CN); Yu Feng, Beijing (CN); Jiangnan Lu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/052,893

(22) PCT Filed: Dec. 24, 2019

(86) PCT No.: PCT/CN2019/127851

§ 371 (c)(1),
(2) Date: Nov. 4, 2020

(87) PCT Pub. No.: WO2020/147529

PCT Pub. Date: Jul. 23, 2020

(65) Prior Publication Data

US 2021/0142709 A1 May 13, 2021

(30) Foreign Application Priority Data

Jan. 14, 2019 (CN) ..... 201910032107.7

(51) Int. Cl.
*G09G 3/20* (2006.01)

(52) U.S. Cl.
CPC ..... *G09G 3/20* (2013.01); *G09G 2300/0408* (2013.01); *G09G 2310/0286* (2013.01)

(58) Field of Classification Search
CPC ..... G09G 2300/0426; G09G 3/3674; G09G 3/3426; G09G 2300/0443; G09G 3/2074; G09G 2300/0408; G09G 2310/0286
See application file for complete search history.

(56) References Cited

U.S. PATENT DOCUMENTS

2007/0001953 A1* 1/2007 Jang ..... G09G 3/3607 345/88
2008/0068358 A1* 3/2008 Lee ..... G09G 3/3659 345/204

(Continued)

FOREIGN PATENT DOCUMENTS

CN 105590601 A 5/2016
CN 107039014 A 8/2017

(Continued)

OTHER PUBLICATIONS

China Patent Office, First Office Action dated Mar. 17, 2020, for corresponding Chinese application 201910032107.7.

(Continued)

*Primary Examiner* — Gerald Johnson
(74) *Attorney, Agent, or Firm* — Houtteman Law LLC

(57) ABSTRACT

A gate driving circuit and a display substrate are provided. The gate driving circuit may provide a driving signal to gate lines, and include output units cascaded to each other and having a same circuit structure. Each output unit includes at least one output transistor, outputs the driving signal to a corresponding gate line through the output transistor, and all the at least one output transistor is coupled to one gate line. The output units are classified as first and second output units. A number of sub-pixels coupled to the gate line corresponding to each first output unit is greater than a number of sub-pixels coupled to the gate line corresponding to each second output unit, and an output capability of at least one output transistor of the first output unit is greater than an output capability of a corresponding output transistor of the second output unit.

20 Claims, 2 Drawing Sheets

(56) References Cited

U.S. PATENT DOCUMENTS

| | | | | |
|---|---|---|---|---|
| 2011/0169874 | A1* | 7/2011 | Jang | G09G 3/3677 345/690 |
| 2015/0269897 | A1* | 9/2015 | Kitsomboonloha | G09G 3/3648 345/205 |
| 2016/0049124 | A1 | 2/2016 | Tsuei et al. | |
| 2016/0328045 | A1* | 11/2016 | Wang | G09G 3/3677 |
| 2017/0178583 | A1 | 6/2017 | Zhang et al. | |
| 2018/0314117 | A1* | 11/2018 | Huang | H03K 21/08 |
| 2019/0058029 | A1* | 2/2019 | Woo | H01L 27/323 |
| 2019/0371251 | A1 | 12/2019 | Fan et al. | |
| 2019/0385510 | A1* | 12/2019 | Kim | H01L 27/3223 |
| 2020/0020263 | A1* | 1/2020 | Shin | G02F 1/13458 |
| 2020/0020291 | A1 | 1/2020 | Huang | |
| 2020/0143764 | A1 | 5/2020 | Liu | |

FOREIGN PATENT DOCUMENTS

| | | | |
|---|---|---|---|
| CN | 107731153 | A | 2/2018 |
| CN | 108010920 | A | 5/2018 |
| CN | 108417172 | A | 8/2018 |
| CN | 108447439 | A | 8/2018 |
| CN | 108682372 | A | 10/2018 |
| CN | 108962176 | A | 12/2018 |
| CN | 109637421 | A | 4/2019 |
| CN | 109637423 | A | 4/2019 |

OTHER PUBLICATIONS

China Patent Office, First Office Action dated Sep. 14, 2020, for corresponding Chinese application 201910032107.7.

China Patent Office, Rejection dated Jan. 25, 2021, for corresponding Chinese application 201910032107.7.

* cited by examiner

GATE DRIVING CIRCUIT AND DISPLAY SUBSTRATE

CROSS REFERENCE TO RELATED APPLICATIONS

This is a National Phase Application filed under 35 U.S.C. 371 as a national stage of PCT/CN2019/127851 filed on Dec. 24, 2019, an application claiming the priority of Chinese patent application No. 201910032107.7, filed on Jan. 14, 2019, the content of each of which is incorporated herein by reference in its entirety.

TECHNICAL FIELD

The present disclosure relates to the field of display technologies, and in particular, to a gate driving circuit and a display substrate.

BACKGROUND

With the development of display technologies, a screen-to-body ratio (e.g., a ratio of an area of a display region to the total area of a front surface), an ultra-narrow border, and the like of a display device have attracted wide attention. In order to increase the screen-to-body ratio of the display device as much as possible, a related display device is provided with a hetero-shaped region (which may also be referred to as irregularly shaped region or special-shaped region) in which a camera, a receiver, a circuit board and the like are installed. Each row of sub-pixels of the display device is coupled with a gate line, and different gate lines are provided with signals by cascaded shift registers (i.e., by a gate driving circuit).

SUMMARY

One aspect of the present disclosure provides a gate driving circuit configured to provide a driving signal to a plurality of gate lines, and including: a plurality of output units cascaded to each other.

The plurality of output units have a same circuit structure, each of the plurality of output units includes at least one output transistor, each of the plurality of output units outputs the driving signal to a corresponding gate line through the at least one output transistor, all the at least one output transistor of each of the plurality of output units is coupled to one of the plurality of gate lines, and the plurality of output units are classified as a first output unit and a second output unit.

A number of sub-pixels coupled to the gate line corresponding to each first output unit is greater than a number of sub-pixels coupled to the gate line corresponding to each second output unit, and an output capability of at least one output transistor of the first output unit is greater than an output capability of an output transistor, which corresponds to the at least one output transistor of the first output unit, of the second output unit.

Further optionally, each output transistor includes a source, a drain, and an active region coupling the source and the drain to each other; and a size of the active region of the at least one output transistor of the first output unit is different from a size of the active region of the output transistor, which corresponds to the at least one output transistor of the first output unit, of the second output unit, such that the output capability of the at least one output transistor of the first output unit is different from the output capability of the output transistor, which corresponds to the at least one output transistor of the first output unit, of the second output unit.

Further optionally, a width-to-length ratio of the active region of the at least one output transistor of the first output unit is greater than a width-to-length ratio of the active region of the output transistor, which corresponds to the at least one output transistor of the first output unit, of the second output unit; and a portion of the active region between the source and the drain is a semiconductor region, a length of the active region represents a size of the semiconductor region in a length direction from the source to the drain, and a width of the active region represents a size of the semiconductor region in a direction perpendicular to the length direction of the semiconductor region.

Further optionally, a ratio of the width-to-length ratio of the active region of the at least one output transistor of the first output unit to a number of the sub-pixels coupled to the gate line corresponding to the first output unit is a first ratio, a ratio of the width-to-length ratio of the active region of the output transistor, which corresponds to the at least one output transistor of the first output unit, of the second output unit to a number of the sub-pixels coupled to the gate line corresponding to the second output unit is a second ratio, and the first ratio is equal to the second ratio.

Further optionally, the at least one output transistor of each of the output units includes: a first sub-output transistor configured to provide a turn-on signal to the gate line corresponding to the output unit including the first sub-output transistor, wherein an output capacity of the first sub-output transistor of the first output unit is greater than an output capacity of the first sub-output transistor of the second output unit.

Further optionally, the at least one output transistor of each of the output units includes: a second sub-output transistor configured to provide a turn-off signal to the gate line corresponding to the output unit including the second sub-output transistor, wherein an output capacity of the second sub-output transistor of the first output unit is greater than an output capacity of the second sub-output transistor of the second output unit.

Another aspect of the present disclosure provides a display substrate, which includes: a plurality of sub-pixels; a plurality of gate lines coupled to the plurality of sub-pixels, wherein the plurality of gate lines are classified as at least two types according to a number of the sub-pixels coupled to each of the plurality of gate lines; and the gate driving circuit according to any one of the foregoing embodiments of the one aspect, wherein all the at least one output transistor of each of the plurality of output units of the gate driving circuit is coupled to one of the plurality of gate lines.

Further optionally, the display substrate includes a hetero-shaped region, wherein no sub-pixel is in the hetero-shaped region; the plurality of sub-pixels are in a plurality of rows, the hetero-shaped region passes through at least a part of the plurality of rows of sub-pixels, and a number of the sub-pixels in each row through which the hetero-shaped region passes is less than a number of the sub-pixels in each row through which no hetero-shaped region passes; and each of the plurality of gate lines is coupled to one row of sub-pixels.

Further optionally, the hetero-shaped region is in a peripheral region of the display substrate.

Further optionally, the hetero-shaped region is configured to house any one of a driving unit, a camera and a receiver.

DETAILED DESCRIPTION

Figure 1:
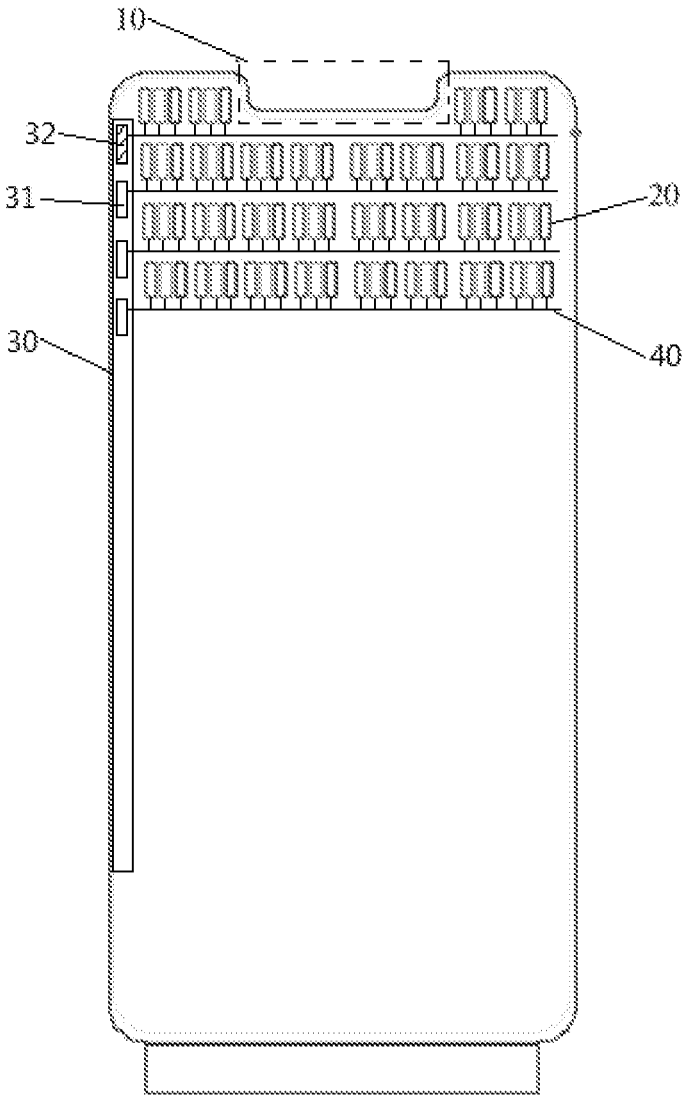
FIG. 1 is a schematic diagram showing a structure of a display substrate according to an embodiment of the present disclosure.

The present disclosure will be described in more detail below with reference to the accompanying drawings. Like elements are denoted by like reference signs throughout the various figures. For purposes of clarity, various features in the drawings may not necessarily be drawn to scale. Further, certain well-known elements may not be shown in the figures.

Numerous specific details of the present disclosure, such as structures, materials, dimensions (i.e., sizes), treatment processes and techniques of components, are set forth in the following description in order to provide a more thorough understanding of the present disclosure. However, as will be understood by one of ordinary skill in the art, the present disclosure may be practiced without these specific details.

The inventors of the present inventive concept have found that, in the related display device, due to the presence of the hetero-shaped region, the number of sub-pixels in each row in which the hetero-shaped region is located is less than the number of sub-pixels in each row in which no hetero-shaped region is located, such that a load of a gate line corresponding to the row through which the hetero-shaped region passes is less than a load of a gate line corresponding to the row through which no hetero-shaped region passes. Therefore, when signals are supplied, by the cascaded shift registers, to the gate lines coupled to different numbers of sub-pixels, a brightness of the row with less sub-pixels is greater than a brightness of the row with more sub-pixels, thereby resulting in display nonuniformity (e.g., two regions with different brightnesses). It is therefore desirable to provide a display substrate having at least the advantages such as uniform display brightness and the like.

Figure 2A:
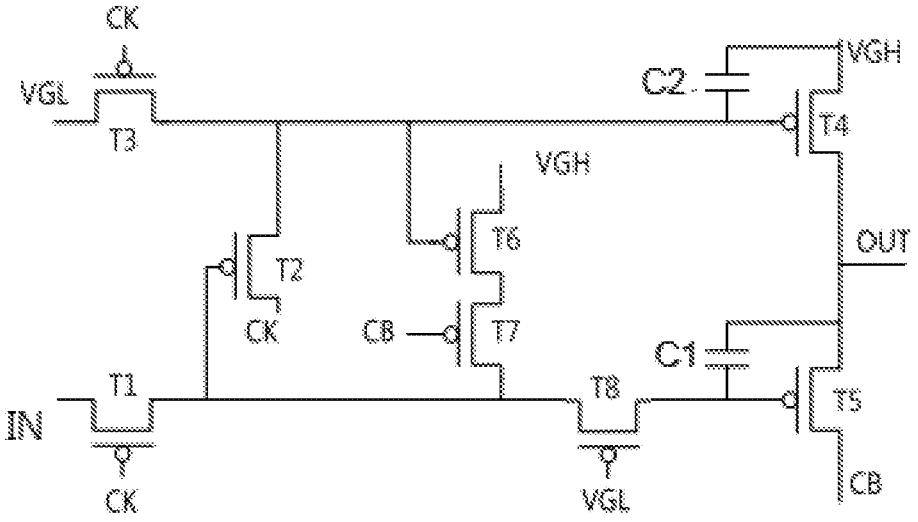
FIG. 2*a* is a schematic diagram showing a circuit structure of an output unit of a gate driving circuit of a display substrate according to an embodiment of the present disclosure.
Figure 2B:
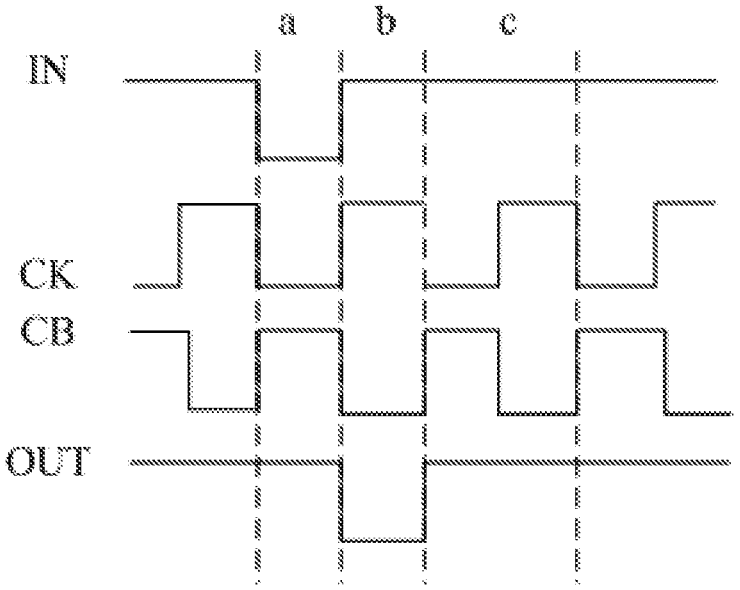
FIG. 2*b* is a driving timing diagram of the output unit shown in FIG. 2*a*.

As shown in FIGS. 1, 2*a* and 2*b*, an embodiment of the present disclosure provides a gate driving circuit 30 for providing a driving signal to gate lines 40. The gate driving circuit 30 may include a plurality of output units that are cascaded to each other in sequence and have a same circuit structure, and each of the output unit includes at least one output transistor. The output units output driving signals to the gate lines 40 through output transistors, respectively, and all of the output transistors in each output unit are coupled with one of the gate lines 40. The output units include a first output unit 31 and a second output unit 32.

The number of the sub-pixels 20 coupled to the gate line 40 corresponding to each first output unit 31 is greater than the number of the sub-pixels 20 coupled to the gate line 40 corresponding to each second output unit 32, and an output capability of at least one output transistor in the first output unit 31 is greater than an output capability of an output transistor, which corresponds to the at least one output transistor in the first output unit 31, in the second output unit 32.

That is, for example, each output unit has at least one output transistor, and all of the output transistors in one output unit are coupled to one gate line 40. In other words, each output unit corresponds to one gate line 40, each gate line 40 is coupled to a plurality of sub-pixels 20, and each of the sub-pixels 20 is coupled to only one gate line 40. According to the number of the sub-pixels 20 coupled to each gate line 40, the output units corresponding to the gate lines 40 are classified as the first output unit 31 and the second output unit 32. For example, the gate line 40 corresponding to the first output unit 31 is coupled to 1440 sub-pixels 20, and the gate line 40 corresponding to the second output unit 32 is coupled to 720 sub-pixels 20.

A load coupled to the gate line 40 corresponding to the first output unit 31 is greater than a load coupled to the gate line 40 corresponding to the second output unit 32. If a same driving signal is provided to both of the gate line 40 corresponding to the first output unit 31 and the gate line 40 corresponding to the second output unit 32, a driving energy (e.g., driving current) received by each sub-pixel 20 coupled to the gate line 40 corresponding to the first output unit 31 is smaller than a driving energy received by each sub-pixel 20 coupled to the gate line 40 corresponding to the second output unit 32, such that a brightness of each sub-pixel 20 coupled to the gate line 40 corresponding to the first output unit 31 and a brightness of each sub-pixel 20 coupled to the gate line 40 corresponding to the second output unit 32 are not uniform (i.e., are not identical).

In the gate driving circuit 30 according to the present embodiment, since the output capability of the output transistor coupled to the gate line 40 corresponding to the first output unit 31 (i.e., the gate line 40 with the greater number of the sub-pixels 20 coupled thereto) is greater than the output capability of the output transistor coupled to the gate line 40 corresponding to the second output unit 32 (i.e., the gate line 40 with the smaller number of the sub-pixels 20 coupled thereto), the gate driving circuit 30 may provide different driving signals to the gate line 40 corresponding to the first output unit 31 and the gate line 40 corresponding to the second output unit 32, respectively, such that the sub-pixels 20 corresponding to the first output unit 31 and the sub-pixels 20 corresponding the second output unit 32 may have a same brightness, i.e., the sub-pixels 20 coupled to different gate lines 40 may have a same brightness, which facilitates realization of narrow border of a display device including the gate driving circuit 30.

Of course, although two types of output units (i.e., the first output unit 31 and the second output unit 32) are taken as an example in the foregoing description, the actual gate lines 40 may be further classified as more types according to the numbers of the sub-pixels 20 coupled to the actual gate lines 40. Accordingly, there may be more types of output units, and the output capabilities of output transistors in any two different types of output units may meet the requirements as described above, and detailed description thereof will not be repeated here.

Optionally, each output transistor includes a source, a drain, and an active region coupling the source and the drain to each other. A size of the active region of at least one output transistor in the first output unit 31 is different from a size of the active region of an output transistor, which corresponds to the at least one output transistor in the first output unit 31, in the second output unit 32, such that the output capability of the output transistors in the first output unit 31 is different from the output capability of the corresponding output transistor in the second output unit 32.

That is, for example, by changing the size of the active region of each output transistor to change the driving capability of the output unit including the output transistor, the intensities of the driving signals received by the gate lines 40 respectively corresponding to the first output unit 31 and the second output unit 32 (i.e. the gate lines 40 coupled to different numbers of the sub-pixels 20) are different, thereby ensuring that the sub-pixels 20 coupled to the gate lines 40 respectively corresponding to the first output unit 31 and the second output unit 32 may have a same brightness, and further ensuring an uniform display brightness.

Optionally, a width-to-length ratio (which may be referred to as an aspect ratio) of the active region of at least one output transistor in the first output cell 31 is greater than a width-to-length ratio of the active region of an output transistor, which corresponds to the at least one output transistor in the first output cell 31, in the second output cell 32. For example, a portion of the active region between the source and the drain is a semiconductor region, a length of the active region represents a size of the semiconductor region in a direction from the source to the drain (i.e., a length direction), and a width of the active region represents a size of the semiconductor region in a direction perpendicular to the length direction.

That is, for example, the larger the width-to-length ratio of the active region of each output transistor is, the greater the output capability of an output unit including the output transistor is. In other words, in a case where the active region of each output transistor has a fixed length, the larger the width of the active region is, the greater the output capability of the output transistor is. Further, in a case where the active region of each output transistor has a fixed width, the smaller the length of the active region is, the greater the output capability of the output transistor is.

The length and the width of the active region of each output transistor may be changed by only changing a mask for forming the active region (i.e., changing a size of an opening of the mask), therefore the output transistors with different output capacities may be formed without changing the original manufacturing process, thereby reducing the complexity of forming the output transistors with different output capacities, and reducing the cost accordingly.

Optionally, a ratio of the width-to-length ratio of the active region of at least one output transistor in each first output unit 31 to the number of the sub-pixels 20 coupled to the gate line 40 corresponding to the first output unit 31 is a first ratio, and a ratio of the width-to-length ratio of the active region of the output transistor, which corresponds to the at least one output transistor in each first output unit 31, in each second output unit 32 to the number of the sub-pixels 20 coupled to the gate line 40 corresponding to the second output unit 32 is a second ratio. The first ratio is equal to the second ratio.

That is, for example, in a case where the width-to-length ratio of the active region of the output transistor in each output unit is directly proportional to the number of the sub-pixels 20 coupled to the gate line 40 corresponding to the output unit, it is possible to ensure that all the sub-pixels 20 have a same brightness.

For example, for a gate line 40 with 720 sub-pixels 20 coupled thereto, the width and length of the active region of an output transistor corresponding to the gate line 40 are 25 μm and 3.3 μm, respectively, i.e., the width-to-length ratio of the active region is 25/3.3. Further, for a gate line 40 with 1440 sub-pixels 20 coupled thereto, the width and length of the active region of an output transistor corresponding to the gate line 40 are 50 μm and 3.3 μm, respectively, i.e. the width-to-length ratio of the active region is 50/3.3.

Of course, although an example in which the output capability of each output transistor is changed by changing the size of the active region of the output transistor is described above, the output capability of each output transistor may alternatively be changed by changing a material of the active region of the output transistor, the structure of the output transistor, or the like.

Optionally, the output transistors includes a first sub-output transistor for providing a turn-on signal to the gate line 40 corresponding to the output unit including the first sub-output transistor. The output capability of a first sub-output transistor in each first output unit 31 is greater than the output capability of a first sub-output transistor in each second output unit 32.

That is, for example, the width-to-length ratios of the active regions of the different first sub-output transistors in the first output unit 31 and the second output unit 32 are directly proportional to the numbers of the sub-pixels 20 corresponding to the first output unit 31 and the second output unit 32, respectively, so as to ensure that the sub-pixels 20 coupled to different gate lines 40 receive the same driving energy, and thus the sub-pixels 20 coupled to different gate lines 40 have the same brightness. Since each first sub-output transistor outputs the turn-on signal, i.e., each first sub-output transistor writes (e.g., inputs or supplies) the turn-on signal into the sub-pixels 20, the brightness of the sub-pixels 20 is greatly affected by the first sub-output transistor. Thus, optionally, the driving capability of the first sub-output transistor in each output unit may be changed.

Optionally, each output transistor may further include a second sub-output transistor for providing a turn-off signal to the gate line 40 corresponding to the output unit including the second sub-output transistor. For example, the output capability of the second sub-output transistor in each first output unit 31 is greater than the output capability of the second sub-output transistor in each second output unit 32.

That is, for example, the width-to-length ratios of the active regions of the different second sub-output transistors in the first output unit 31 and the second output unit 32 is directly proportional to the numbers of the sub-pixels 20 corresponding to the first output unit 31 and the second output unit 32, respectively, so as to ensure that the sub-pixels 20 of different gate lines 40 receive the same driving energy, and thus ensure that turn-off processes of the sub-pixels 20 coupled to different gate lines 40 are identical (e.g., response times of the turn-off processes are equal to each other, and the like).

Specifically, each of the output units in the gate driving circuit 30 according to the present embodiment is shown in FIGS. 2*a* and 2*b*. Each output unit (e.g., a shift register GOA) may include 8 P-type transistors (each of the P-type transistors is turned off at a high level and turned on at a low level), that is, a first transistor T1, a second transistor T2, a third transistor T3, a fourth transistor T4, a fifth transistor T5, a sixth transistor T6, a seventh transistor T7, and an eighth transistor T8, and may include 2 storage capacitors. For example, an output terminal OUT of each output unit is coupled to an input terminal IN of the output unit in the next stage, and an input terminal IN of the output unit in a first stage is coupled to a separate control terminal. For example, the fifth transistor T5 is equivalent to the above-described first sub-output transistor, and the fourth transistor T4 is equivalent to the above-described second sub-output transistor.

In a method for driving each of the output units, a low level is continuously provided to a first voltage terminal VGL, and a high level is continuously provided to a second voltage terminal VGH; and the method may include the following steps S11 to S13.

In step S11, during a first stage a, a low level is provided to the input terminal IN, a low level is provided to a first clock terminal CK, and a high level is provided to a second clock terminal CB.

The low levels output from the input terminal IN and the first clock terminal CK enable the first transistor T1, the second transistor T2, the third transistor T3, the fourth transistor T4, and the fifth transistor T5 to be turned on, and enable the seventh transistor T7 to be turned off. Thus, the output terminal OUT finally outputs the high level of the second voltage terminal VGH and the second clock terminal CB.

In step S12, during a second stage b, a high level is provided to the input terminal IN, a high level is provided to the first clock terminal CK, and a low level is provided to the second clock terminal CB.

The high levels output from the input terminal IN and the first clock terminal CK enable the first transistor T1 and the third transistor T3 to be turned off, and a first storage capacitor C1 maintains a gate of the second transistor T2 at a low level, such that the second transistor T2 is turned on, and the fourth transistor T4 is turned off. Further, the first storage capacitor C1 maintains a gate of the fifth transistor T5 at a low level, such that the fifth transistor T5 is turned on, and the second clock terminal CB provides a signal to the output terminal OUT.

In step S13, during a third stage c, a high level is provided to the input terminal IN, and the levels of the first clock terminal CK and the second clock terminal CB are opposite to each other, i.e. one of the levels of the first clock terminal CK and the second clock terminal CB is a high level, and the other is a low level.

When the low level is provided to the first clock terminal CK and the high level is provided to the second clock terminal CB, the high level from the input terminal IN and the low level from the first clock terminal CK enable the first transistor T1, the third transistor T3, and the fourth transistor T4 to be turned on, and enable the second transistor T2, the fifth transistor T5, and the seventh transistor T7 to be turned off, thereby causing the second voltage terminal VGH to provide a signal to the output terminal OUT.

When a high level is provided to the first clock terminal CK and a low level is provided to the second clock terminal CB, the high levels from the input terminal IN and the first clock terminal CK enable the first transistor T1 and the third transistor T3 to be turned off. The second storage capacitor C2 maintains a gate of the sixth transistor T6 at a low level, such that the sixth transistor T6 is turned on. The low level from the second clock terminal CB enables the seventh transistor T7 to be turned on, and in turn enables the fifth transistor T5 to be turned off. The second storage capacitor C2 maintains a gate of the fourth transistor T4 at a low level, such that the fourth transistor T4 is turned on, which allows the second voltage terminal VGH to provide a signal to the output terminal OUT.

The third stage c continues until the input terminal IN is at a low level in a next stage again, i.e. until the first stage a of a next frame starts.

Of course, it is feasible to apply the method to an output unit with other configurations, although the method is described above by taking the output unit with a specific configuration as an example.

As shown in FIGS. 1, 2*a* and 2*b*, an embodiment of the present disclosure provides a display substrate, which may include the following components:

a plurality of sub-pixels 20;

a plurality of gate lines 40 coupled to the sub-pixels 20, the gate lines 40 being classified as at least two types according to the number of the sub-pixels 20 coupled to each of the gate lines 40; and the gate driving circuit 30 according to any one of the foregoing embodiments, all the output transistors of each output unit of the gate driving circuit 30 being coupled to one of the gate lines 40.

That is, for example, each output unit includes at least one output transistor, and all of the output transistors of one output unit are coupled to one gate line 40. In other words, each output unit corresponds to one gate line 40, each gate line 40 is coupled to a plurality of sub-pixels 20, and each sub-pixel 20 is coupled to only one gate line 40. The gate lines 40 are classified as at least two types according to the numbers of the sub-pixels 20 respectively coupled to the gate lines 40. For example, the plurality of gate lines 40 are classified as two types, the number of the sub-pixels 20 coupled to each gate line 40 of one type is 720, and the number of the sub-pixels 20 coupled to each gate line 40 of the other type is 1440.

Each gate line 40 coupled to a larger number of the sub-pixels 20 has a larger load. Thus, if a same driving signal is provided to all of the gate lines 40, the driving energies received by the sub-pixels 20 coupled to different types of gate lines 40 are different, such that the sub-pixels 20 have nonuniform (i.e., different) brightnesses. In the display substrate according to the present embodiment, the output capability of each output transistor corresponding to the gate line 40 coupled to more sub-pixels 20 is greater than the output capability of each output transistor corresponding to the gate line 40 coupled to less sub-pixels 20, and thus different driving signals may be provided, by the gate driving circuit 30, to the gate lines 40 coupled to different numbers of the sub-pixels 20. As a result, the brightnesses of the sub-pixels 20 corresponding to different gate lines 40 may be identical, and the display brightnesses of all the sub-pixels 20 are uniform.

Optionally, the display substrate includes an hetero-shaped region 10, and each of the sub-pixels 20 is not located in the hetero-shaped region. The plurality of sub-pixels 20 are arranged in a plurality of rows, and the hetero-shaped region passes through at least a part of the rows of sub-pixels 20. The number of the sub-pixels 20 in each row through which the hetero-shaped region 10 passes is less than the number of the sub-pixels 20 in each row through which no hetero-shaped region 10 passes, and each of the gate lines 40 is coupled to one row of the sub-pixels 20.

That is, for example, the number of the sub-pixels 20 coupled to each gate line 40 corresponding to the row through which the hetero-shaped region passes (hereinafter referred to as the gate line 40 through which the hetero-shaped region passes) is less than the number of the sub-pixels 20 coupled to each gate line 40 corresponding to the row through which no hetero-shaped region passes (hereinafter referred to as the gate line 40 through which no hetero-shaped region passes), and the output capability of each output transistor corresponding to the gate line 40 through which the hetero-shaped region passes is less than the output capability of each output transistor corresponding to the gate line 40 through which no hetero-shaped region passes. That is, the width-to-length ratio of each output transistor corresponding to the gate line 40 through which the hetero-shaped region passes is less than the width-to-length ratio of each output transistor corresponding to the gate line 40 through which no hetero-shaped region passes.

For example, the number of the sub-pixels 20 in each row through which the hetero-shaped region passes is 720, the active region of a first output transistor corresponding to the row has a width of 25 μm and a length of 3.3 μm, and the active region of a second output transistor corresponding to the row has a width of 50 μm and a length of 3.3 μm. The number of the sub-pixels 20 in each row through which no hetero-shaped region passes is 1440, the active region of a first output transistor corresponding to the row has a width of 50 μm and a length of 3.3 μm, and the active region of a second output transistor corresponding to the row has a width of 100 μm and a length of 3.3 μm, respectively.

Optionally, the hetero-shaped region 10 is disposed in a peripheral region of the display substrate.

Specifically, the hetero-shaped region may be disposed in the upper peripheral region of the display substrate.

Optionally, any one of a driving unit, a camera, and a receiver (e.g., an earpiece) may be disposed in the hetero-shaped region 10.

For example, the driving unit may be a source driving circuit (e.g., integrated circuit (IC)) or other drivers.

Specifically, the display substrate according to the present embodiment may be included in a display device, and the display device may be any product or component having a display function, such as a liquid crystal display panel, an organic light emitting diode (OLED) display panel, electronic paper, a mobile phone, a tablet computer, a television, a display, a notebook computer, a digital photo frame, a navigator, or the like.

It should be noted that, relational terms such as "first", "second", and the like used herein are solely for distinguishing one entity or action from another entity or action without necessarily requiring or implying any actual such relationship or order between such entities or actions. Further, the terms "comprise", "include", or any other variation thereof, is intended to cover a non-exclusive inclusion, such that a process, method, article, or apparatus that contains a list of elements may further contain other elements not expressly listed or inherent to such process, method, article, or apparatus. An element defined by the phrase "comprising a/an . . . ", without further limitation, does not exclude the presence of other identical elements in the process, method, article, or apparatus that includes the element.

Exemplary embodiments in accordance with the present disclosure have been described above, but are not exhaustive and do not limit the present disclosure to the exemplary embodiments described. It is apparent to one of ordinary skill in the art that, many modifications and variations are possible in light of the above description. The embodiments are chosen and described in order to best explain the principles of the present disclosure and the practical applications thereof, to thereby enable one of ordinary skill in the art to best utilize the present disclosure and various modifications based on the present disclosure. The scope of the present disclosure is limited only by the appended claims and their equivalents.

What is claimed is:

1. A gate driving circuit configured to provide a driving signal to a plurality of gate lines, and comprising: a plurality of output units cascaded to each other, wherein the plurality of output units have a same circuit structure, each of the plurality of output units comprises at least one output transistor, each of the plurality of output units outputs the driving signal to a corresponding gate line through the at least one output transistor, all the at least one output transistor of each of the plurality of output units is coupled to one of the plurality of gate lines, and the plurality of output units are classified as a first output unit and a second output unit; and a number of sub-pixels coupled to the gate line corresponding to each first output unit is greater than a number of sub-pixels coupled to the gate line corresponding to each second output unit, and an output capability of at least one output transistor of the first output unit is greater than an output capability of an output transistor, which corresponds to the at least one output transistor of the first output unit, of the second output unit.

2. The gate driving circuit according to claim 1, wherein each output transistor comprises a source, a drain, and an active region coupling the source and the drain to each other; and a size of the active region of the at least one output transistor of the first output unit is different from a size of the active region of the output transistor, which corresponds to the at least one output transistor of the first output unit, of the second output unit, such that the output capability of the at least one output transistor of the first output unit is different from the output capability of the output transistor, which corresponds to the at least one output transistor of the first output unit, of the second output unit.

3. The gate driving circuit according to claim 2, wherein a width-to-length ratio of the active region of the at least one output transistor of the first output unit is greater than a width-to-length ratio of the active region of the output transistor, which corresponds to the at least one output transistor of the first output unit, of the second output unit; and a portion of the active region between the source and the drain is a semiconductor region, a length of the active region represents a size of the semiconductor region in a length direction from the source to the drain, and a width of the active region represents a size of the semiconductor region in a direction perpendicular to the length direction of the semiconductor region.

4. The gate driving circuit according to claim 3, wherein a ratio of the width-to-length ratio of the active region of the at least one output transistor of the first output unit to a number of the sub-pixels coupled to the gate line corresponding to the first output unit is a first ratio, a ratio of the width-to-length ratio of the active region of the output transistor, which corresponds to the at least one output transistor of the first output unit, of the second output unit to a number of the sub-pixels coupled to the gate line corresponding to the second output unit is a second ratio, and the first ratio is equal to the second ratio.

5. The gate driving circuit according to claim 1, wherein the at least one output transistor of each of the first and second output units comprises:

a first sub-output transistor configured to provide a turn-on signal to the gate line corresponding to the output unit comprising the first sub-output transistor, wherein an output capacity of the first sub-output transistor of the first output unit is greater than an output capacity of the first sub-output transistor of the second output unit.

6. The gate driving circuit according to claim 1, wherein the at least one output transistor of each of the first and second output units comprises:

a second sub-output transistor configured to provide a turn-off signal to the gate line corresponding to the output unit comprising the second sub-output transistor, wherein an output capacity of the second sub-output transistor of the first output unit is greater than an output capacity of the second sub-output transistor of the second output unit.

7. A display substrate, comprising:

a plurality of sub-pixels;

a plurality of gate lines coupled to the plurality of sub-pixels, wherein the plurality of gate lines are classified as at least two types according to a number of the sub-pixels coupled to each of the plurality of gate lines; and the gate driving circuit according to claim 1, wherein all the at least one output transistor of each of the plurality of output units of the gate driving circuit is coupled to one of the plurality of gate lines.

8. The display substrate according to claim 7, comprising a hetero-shaped region, wherein no sub-pixel is in the hetero-shaped region;

the plurality of sub-pixels are in a plurality of rows, the hetero-shaped region passes through at least a part of the plurality of rows of sub-pixels, and a number of the sub-pixels in each row through which the hetero-shaped region passes is less than a number of the sub-pixels in each row through which no hetero-shaped region passes; and each of the plurality of gate lines is coupled to one row of sub-pixels.

9. The display substrate according to claim 7, wherein the hetero-shaped region is in a peripheral region of the display substrate.

10. The display substrate according to claim 7, wherein the hetero-shaped region is configured to house any one of a driving unit, a camera and a receiver.

11. The gate driving circuit according to claim 2, wherein the at least one output transistor of each of the first and second output units comprises:

a first sub-output transistor configured to provide a turn-on signal to the gate line corresponding to the output unit comprising the first sub-output transistor, wherein an output capacity of the first sub-output transistor of the first output unit is greater than an output capacity of the first sub-output transistor of the second output unit.

12. The gate driving circuit according to claim 3, wherein the at least one output transistor of each of the first and second output units comprises:

a first sub-output transistor configured to provide a turn-on signal to the gate line corresponding to the output unit comprising the first sub-output transistor, wherein an output capacity of the first sub-output transistor of the first output unit is greater than an output capacity of the first sub-output transistor of the second output unit.

13. The gate driving circuit according to claim 4, wherein the at least one output transistor of each of the first and second output units comprises:

a first sub-output transistor configured to provide a turn-on signal to the gate line corresponding to the output unit comprising the first sub-output transistor, wherein an output capacity of the first sub-output transistor of the first output unit is greater than an output capacity of the first sub-output transistor of the second output unit.

14. The gate driving circuit according to claim 2, wherein the at least one output transistor of each of the first and second output units comprises:

a second sub-output transistor configured to provide a turn-off signal to the gate line corresponding to the output unit comprising the second sub-output transistor, wherein an output capacity of the second sub-output transistor of the first output unit is greater than an output capacity of the second sub-output transistor of the second output unit.

15. The gate driving circuit according to claim 3, wherein the at least one output transistor of each of the first and second output units comprises:

a second sub-output transistor configured to provide a turn-off signal to the gate line corresponding to the output unit comprising the second sub-output transistor, wherein an output capacity of the second sub-output transistor of the first output unit is greater than an output capacity of the second sub-output transistor of the second output unit.

16. The gate driving circuit according to claim 4, wherein the at least one output transistor of each of the first and second output units comprises:

a second sub-output transistor configured to provide a turn-off signal to the gate line corresponding to the output unit comprising the second sub-output transistor, wherein an output capacity of the second sub-output transistor of the first output unit is greater than an output capacity of the second sub-output transistor of the second output unit.

17. The gate driving circuit according to claim 5, wherein the at least one output transistor of each of the first and second output units comprises:

a second sub-output transistor configured to provide a turn-off signal to the gate line corresponding to the output unit comprising the second sub-output transistor, wherein an output capacity of the second sub-output transistor of the first output unit is greater than an output capacity of the second sub-output transistor of the second output unit.

18. The gate driving circuit according to claim 11, wherein the at least one output transistor of each of the first and second output units comprises:

a second sub-output transistor configured to provide a turn-off signal to the gate line corresponding to the output unit comprising the second sub-output transistor, wherein an output capacity of the second sub-output transistor of the first output unit is greater than an output capacity of the second sub-output transistor of the second output unit.

19. The gate driving circuit according to claim 12, wherein the at least one output transistor of each of the first and second output units comprises:

a second sub-output transistor configured to provide a turn-off signal to the gate line corresponding to the output unit comprising the second sub-output transistor, wherein an output capacity of the second sub-output transistor of the first output unit is greater than an output capacity of the second sub-output transistor of the second output unit.

20. The gate driving circuit according to claim 13, wherein the at least one output transistor of each of the first and second output units comprises:

a second sub-output transistor configured to provide a turn-off signal to the gate line corresponding to the output unit comprising the second sub-output transistor, wherein an output capacity of the second sub-output transistor of the first output unit is greater than an output capacity of the second sub-output transistor of the second output unit.

* * * * *